US009881735B2

(12) United States Patent
Azuma et al.

(10) Patent No.: US 9,881,735 B2
(45) Date of Patent: Jan. 30, 2018

(54) FE-BASED AMORPHOUS TRANSFORMER MAGNETIC CORE, PRODUCTION METHOD THEREFOR, AND TRANSFORMER

(71) Applicants: HITACHI METALS, LTD., Tokyo (JP); JIBU ELECTRIC CO., LTD., Osaka-shi, Osaka (JP)

(72) Inventors: Daichi Azuma, Yasugi (JP); Yuji Nagata, Osaka (JP); Kengo Takahashi, Yasugi (JP)

(73) Assignees: HITACHI METALS, LTD., Tokyo (JP); JIBU ELECTRIC CO., LTD., Osaka (JP)

( * ) Notice: Subject to any disclaimer, the term of this patent is extended or adjusted under 35 U.S.C. 154(b) by 0 days.

(21) Appl. No.: 14/911,798

(22) PCT Filed: Aug. 7, 2014

(86) PCT No.: PCT/JP2014/070921
§ 371 (c)(1),
(2) Date: Feb. 12, 2016

(87) PCT Pub. No.: WO2015/022904
PCT Pub. Date: Feb. 19, 2015

(65) Prior Publication Data

US 2016/0203902 A1 Jul. 14, 2016

(30) Foreign Application Priority Data

Aug. 13, 2013 (JP) ..... 2013-168215

(51) Int. Cl.
*H01F 27/25* (2006.01)
*H01F 41/02* (2006.01)
*H01F 1/153* (2006.01)

(52) U.S. Cl.
CPC ..... *H01F 41/0226* (2013.01); *H01F 1/15308* (2013.01); *H01F 27/25* (2013.01)

(58) Field of Classification Search
None
See application file for complete search history.

(56) References Cited

U.S. PATENT DOCUMENTS 5,486,404 A * 1/1996 Nakajima ..... H01F 1/15341 428/143
5,725,686 A * 3/1998 Yoshizawa ..... H01F 1/15308 148/305
6,425,960 B1 * 7/2002 Yoshizawa ..... H01F 1/15308 148/121
8,007,600 B2 * 8/2011 Ohta ..... C22C 45/02 148/121
2006/0191602 A1 * 8/2006 Hasegawa ..... C22C 33/003 148/304
2009/0184705 A1 * 7/2009 Yoshizawa ..... C22C 38/002 324/142
2009/0266448 A1 * 10/2009 Ohta ..... B22D 11/06 148/121
2010/0108196 A1 * 5/2010 Ohta ..... C21D 8/1211 148/121
2010/0265028 A1 * 10/2010 McHenry ..... C22C 33/003 336/221
2011/0272065 A1 * 11/2011 Ohta ..... B82Y 25/00 148/540
2012/0318412 A1 * 12/2012 Ohta ..... C21D 8/1211 148/548
2016/0196907 A1 * 7/2016 Ohta ..... C21D 6/008 148/108
2016/0196908 A1 * 7/2016 Ohta ..... C21D 8/125 336/213
2017/0096721 A1 * 4/2017 Francoeur ..... C21D 8/1272

FOREIGN PATENT DOCUMENTS

JP 2008-177517 A 7/2008
JP 2010-273489 A 12/2010
JP 2012-120251 A 6/2012

* cited by examiner

*Primary Examiner* — Kevin M Bernatz
(74) *Attorney, Agent, or Firm* — Sughrue Mion, PLLC

(57) ABSTRACT

The present invention provides an Fe-based amorphous transformer magnetic core formed by stacking Fe-based amorphous alloy thin strips and satisfying the following (1) to (3) in a direct current B-H curve measured by applying a magnetic field of 80 A/m to the magnetic core:

$$B80 \geq 1.1\ T \quad (1)$$

$$0.5\ T \leq Br \leq 0.7\ T \quad (2)$$

$$B80 - Br \geq 0.6\ T \quad (3)$$

wherein B80 represents a magnetic flux density (T) obtained when magnetization is performed in the magnetic field of 80 A/m, and Br represents a residual magnetic flux density (T) obtained when a magnetic field is changed to 0 A/m after magnetization is performed in a magnetic field of 80 A/m.

4 Claims, 3 Drawing Sheets

FIG.2
Conventional
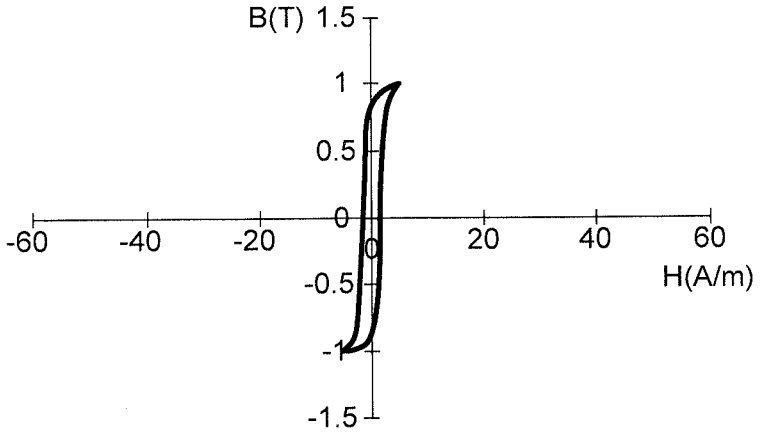

FE-BASED AMORPHOUS TRANSFORMER MAGNETIC CORE, PRODUCTION METHOD THEREFOR, AND TRANSFORMER

CROSS REFERENCE TO RELATED APPLICATIONS

This application is a National Stage of International Application No. PCT/JP2014/070921filed Aug. 7, 2014 (claiming priority based on Japanese Patent Application No. 2013-168215 filed Aug. 13, 2013 ), the contents of which are incorporated herein by reference in their entirety.

TECHNICAL FIELD

The present invention relates to an Fe-based amorphous transformer magnetic core, which is suitable for a boosting transformer of an inverter output voltage placed on a power conditioner, a production method therefor, and a transformer using the same.

BACKGROUND ART

As a power generation method without emission of carbon dioxide, which is considered to be effective to reduce global warming, solar power generation and wind power generation have attracted attention in recent years.

In the solar power generation, a generated DC power is converted into an AC power of a desired frequency through an inverter. The AC power is boosted to a voltage of a commercial power system by a boosting transformer and then connected to a commercial power network. Also in the wind power generation, a generated AC power is converted into a DC power, and the DC power is further converted into an AC power of a desired frequency through an inverter, thereby contributing to enhancement of power generation efficiency.

In the solar power generation, an amount of generated power varies depending on weather conditions, the temporal change of the altitude of the sun, and so on. In the wind power generation, a power generation amount varies depending on wind speed changing momentarily. Thus, with respect to the varying power generation amount, when the DC power is converted into an AC power by an inverter and further boosted to a given voltage of a commercial power system by a boosting transformer, various control circuits are required. Such an inverter, control circuit, boosting transformer, and the like are collectively generally called a power conditioner.

A power conditioner used in the solar power generation and the wind power generation is designed in view of variation of the power generation amount within the year and daily variation of the power generation amount. However, in actual operation, a time for which the rated power generation amount is obtained is a portion of all operating time, and it is often operated in an output band less than the rated output. For example, in the solar power generation, it is considered that the largest power is generated in an output band which is 30% to 70% of the rated output (% with respect to the rated output) (see, for example, Japanese Patent Application Laid-Open (JP-A) Nos. 2010-273489 and 2012-120251).

As a boosting transformer, a transformer using a silicon steel sheet in a magnetic core has been conventionally used. However, as described above, in actual operation, the time for which the rated power generation amount is obtained is short, and degradation of conversion efficiency in the output band less than the rated output has been a problem. In association with such a situation, JP-A Nos. 2010-273489 and 2012-120251 propose a technique in which an amorphous transformer using a magnetic core including stacked Fe-based amorphous alloy thin strips considered to have high energy conversion efficiency compared with a transformer using a magnetic core formed of a silicon steel sheet is adopted in a region with a low load rate, thereby increasing the efficiency of a power conditioner.

A transformer may be held in a so-called residual magnetization state in which the transformer is maintained in a magnetized state by shutdown of an inverter or the like. In this state, the transformer easily reaches magnetic saturation in resuming operation, and normal operation cannot be performed.

In the prior art, in order to prevent occurrence of the magnetic saturation in a power conditioner, a current or voltage input to the input side (primary side) of a boosting transformer and a current or voltage output from the output side (secondary side, boosting side) are detected, and a control circuit is disposed to prevent the magnetic saturation.

For example, as an example of the control circuit, JP-A Nos. 2010-273489 and 2012-120251 disclose a power conditioner which has a function of performing offset correction before start of operation.

However, the control circuit is complex and, in addition, should be designed in accordance with the characteristics for every magnetic core of each transformer, and therefore, the control circuit has a problem in terms of versatility and simplicity.

In addition to the above disclosures, there is a disclosure regarding a transformer which can avoid magnetic saturation even when DC biased magnetization occurs, by having predetermined iron loss (see, for example, JP-A No. 2008-177517).

Further, JP-A No. 2008-177517 discloses that magnetic resistance is increased by annealing without applying a magnetic field to increase magnetic resistance, thus reducing magnetic saturation. Furthermore, JP-A No. 2008-177517 describes that the magnetic resistance is increased by annealing at a low temperature of not more than 300° C., thus reducing the magnetic saturation.

SUMMARY OF INVENTION

Technical Problem

In terms of the fact that a complex control circuit need not necessarily be provided, it is effective to adopt the annealing without applying a magnetic field or the annealing at a low temperature described in JP-A No. 2008-177517 to impart a property of being less likely to be magnetically saturated to a transformer itself.

Here, the magnetic saturation of a transformer will be explained.

FIG. 2 shows a B-H loop (a magnetic hysteresis curve showing a change in magnetic flux density (B) to an external magnetic field (H)) of a conventionally proposed transformer using an Fe-based amorphous alloy thin strip. In normal operation, an alternating magnetic field is applied according to a frequency of AC, and magnetization corresponding to a value on the curve is performed. When operation is stopped, stoppage is performed in such a state that magnetization is somewhat performed according to a magnetic field when the operation stopped. For example, in FIG. 2, when operation is stopped in such a state that H=10

A/m or more, magnetization is performed at about 0.8 T (tesla) which is on a line on the positive side of a magnetic flux density B of the B-H loop at H=0 A/m (the magnetic flux density at H=0 A/m is referred to as a "residual magnetic flux density (T)" and represented by Br).

Subsequently, when operation restarts, operation is performed from the state magnetized at Br=0.8 T. Therefore, if a saturation magnetic flux density (Bs) is about 1.5 T, when there is such an input power that a magnetic field in which a difference between Bs and Br is more than about 0.7 T (=about 1.5–about 0.8) is generated, a magnetic core of the transformer is likely to cause magnetic saturation. Namely, the magnetic core is likely to be held in a state in which no more magnetic flux can pass through a magnetic body, in other words, a state similar to a coil without a magnetic core like an air-core coil. Thus, an induced electromotive force generated by electromagnetic induction becomes very small, so that a large current (excitation rush current) which is not less than 10 times a rated current flows, and there occurs a phenomenon in which normal boosting and operation become difficult.

Namely, in order to obtain a predetermined magnetic flux density in a magnetic hysteresis curve, a corresponding external magnetic field (H) is required to be applied by a coil, and a relationship between the magnetic flux density (B) and the external magnetic field generated by the coil is represented by $B=\mu H$ ($\mu$: permeability). The external magnetic field (H) is proportional to the number of turns (N) and a current (i). Accordingly, when a predetermined magnetic flux density is to be obtained, the smaller the permeability $\mu$ is, the larger the current that is necessary for a primary winding is. In a transformer in which a predetermined magnetic flux density is obtained, if the permeability $\mu$ is small, a large current flows to the primary winding.

Accordingly, a value of the permeability ($\mu$) in an operation range is preferably as high as possible, and this similarly applies to the case in which an operation starting point is set at Br by DC biased magnetization. In other words, it can be said that a higher value (B-Br) obtained by subtracting a residual magnetic flux density from a magnetic flux density is desirable. In terms of only avoidance of occurrence of magnetic saturation during operation, the lower Br is desirable.

Meanwhile, for a transformer, as well as reduction in magnetic saturation, reduction in magnetic core iron loss and reduction in noise are important required characteristics. In terms of only the magnetic saturation described above, although magnetic resistance is increased (the permeability is reduced), a technique which can simultaneously realize reduction in magnetic core iron loss and reduction in noise has not been established.

In view of the above, the present invention provides an Fe-based amorphous transformer magnetic core, which reduces magnetic saturation of a transformer magnetic core without deteriorating a degree of noise, prevents generation of an excessive excitation rush current (large current), and reduces magnetic core iron loss, a method of manufacturing the Fe-based amorphous transformer magnetic core, and a transformer whose operation can stably restart.

Solution to Problem

Specific means for achieving the above objects are as follows.

<1> Provided is an Fe-based amorphous transformer magnetic core formed by stacking Fe-based amorphous alloy thin strips and satisfying the following (1) to (3) in a direct current B-H curve measured by applying a magnetic field of 80 A/m to the magnetic core:

$$B80 \geq 1.1\ T \quad (1)$$

$$0.5\ T \leq Br \leq 0.7\ T \quad (2)$$

$$B80 - Br \geq 0.6\ T \quad (3)$$

In the above (1) to (3), B80 represents a magnetic flux density (T) obtained when magnetization is performed in the magnetic field of 80 A/m, and Br represents a residual magnetic flux density (T) obtained when a magnetic field is changed to 0 A/m after magnetization is performed in a magnetic field of 80 A/m.

In the above <1>, an alloy of the Fe-based amorphous alloy thin strip is preferably an alloy including 2 atomic percent to 13 atomic percent of Si (silicon), 8 atomic percent to 16 atomic percent of B (boron), and not more than 3 atomic percent of C (carbon) with the balance consisting of Fe (iron) and unavoidable impurities.

<2> Provided is a transformer including the Fe-based amorphous transformer magnetic core according to the above <1>, and at least a pair of conductive wires wound around the Fe-based amorphous transformer magnetic core.

<3> The transformer according to the above <2> for connection to an output side of an inverter.

<4> Provided is a method of manufacturing the Fe-based amorphous transformer magnetic core according to the above <1>, including cutting and stacking Fe-based amorphous alloy thin strips to form a layered material, and heat-treating the layered material in a magnetic field of 0 A/m at a holding temperature set to be more than 300° C. but not more than a temperature less by 150° C. than a crystallization starting temperature of the amorphous alloy for a holding time set to be not less than 1 hour but not more than 6 hours.

Advantageous Effects of Invention

The present invention provides an Fe-based amorphous transformer magnetic core, which reduces magnetic saturation of a transformer magnetic core without deteriorating a degree of noise, prevents generation of an excessive excitation rush current (large current), and reduces magnetic core iron loss, and a method of manufacturing the Fe-based amorphous transformer magnetic core. The invention further provides a transformer whose operation can stably restart.

For example, when a transformer of the invention is applied to a power conditioner, a control circuit in the power conditioner can be rendered versatile and simple, and, at the same time, operation of the power conditioner can be stably restarted.

BRIEF DESCRIPTION OF DRAWINGS

FIG. 2 is a direct current B-H curve showing a relationship between the magnetic flux density (B) and the external magnetic field (H) of a conventional magnetic core.

DESCRIPTION OF EMBODIMENTS

Figure 1:
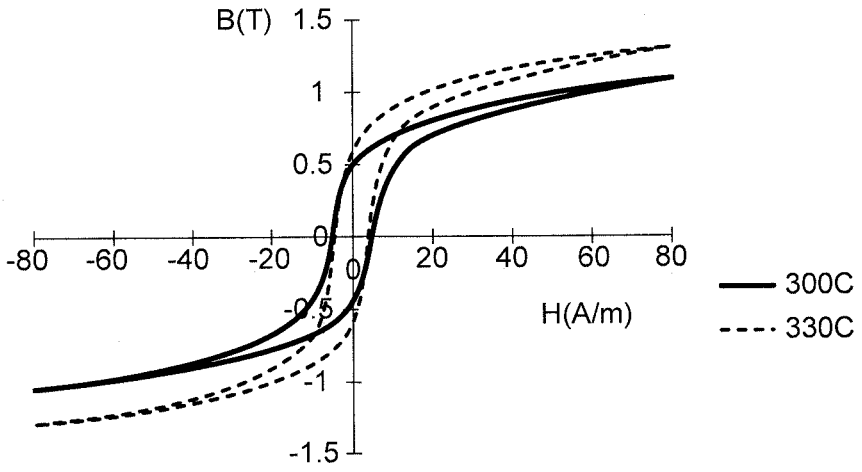
FIG. 1 is a direct current B-H curve showing an example of a relationship between a magnetic flux density (B) and an external magnetic field (H) of an Fe-based amorphous magnetic core manufactured in an example.

Hereinafter, an Fe-based amorphous transformer magnetic core, a method of manufacturing the Fe-based amorphous transformer magnetic core, and a transformer (hereinafter referred to as an "Fe-based amorphous transformer") including this core will be described in detail.

The Fe-based amorphous transformer magnetic core of the present invention is a magnetic core formed by stacking Fe-based amorphous alloy thin strips, and in a direct current B-H curve measured by applying a magnetic field of 80 A/m to the magnetic core, the following (1), (2), and (3) are satisfied. Each unit of B80 and Br is T (tesla).

$$B80 \geq 1.1\ T \quad (1)$$

$$0.5\ T \leq Br \leq 0.7\ T \quad (2)$$

$$B80 - Br \geq 0.6\ T \quad (3)$$

In the above (1) to (3), B80 represents a magnetic flux density (T) obtained when magnetization is performed in a magnetic field of 80 A/m, and Br represents a residual magnetic flux density (T) obtained when a magnetic field is changed to 0 (zero) A/m after magnetization is performed in a magnetic field of 80 A/m.

In the present invention, a "trans" is one called a transformer manufactured by winding at least a pair of conductive wires around a magnetic core. In particular, the transformer is a device which has a magnetic core and two or three or more windings, does not change their positions mutually, receives an AC power from one or two or more circuits, transforms a voltage and a current by an electromagnetic induction action, and supplies the AC power of the same frequency to one or two or more other circuits.

In this invention, a magnetic core formed by stacking Fe-based amorphous alloy thin strips may have any form as long as it has a layered form. Examples of the magnetic core include a so-called layered magnetic core in which thin strips each formed into a predetermined shape are stacked and a so-called wound magnetic core around which thin strips are wound. Especially, the wound magnetic core is advantageous for an extremely thin amorphous alloy thin strip because a layered form can be easily formed.

In the present invention, magnetic characteristics that can be imparted to a layered material formed by stacking Fe-based amorphous alloy thin strips by heat treatment are evaluated and examined, so that this invention has found that the magnetic characteristics which can simultaneously realize, as well as reduction in magnetic saturation, reduction in iron loss and reduction in noise can be imparted to an Fe-based amorphous transformer magnetic core.

As described above, in a transformer required to obtain a predetermined magnetic flux density, the lower the permeability μ is, the larger current flows to a primary winding.

Accordingly, a higher permeability (μ) is preferable, and a higher value (B-Br) obtained by subtracting a residual magnetic flux density from a magnetic flux density is desirable. In terms of avoidance of occurrence of magnetic saturation during operation, the lower Br is desirable. However, if Br becomes low, a magnetization process of a magnetic core becomes magnetization reversal, and noise is likely to increase. Moreover, the iron loss significantly depends on those magnetic characteristics In view of the above, in this invention, B80 and Br satisfy all the above (1) to (3). Thus, the magnetic saturation of a magnetic core is reduced, and generation of an excessive rush current is prevented. In addition, iron loss and noise can be reduced. Evaluation has been performed in a range up to B80 because this range is the range during normal operation in which the iron loss is considered important.

In the present invention, the magnetic flux density (B80) obtained when magnetization is performed in a magnetic field of 80 A/m is not less than 1.1 T. The characteristics that an absolute value of B80 is high is considered to be indispensable for operating a magnetic core without magnetic saturation in normal operation, and theoretically, the higher the value of B80 is, the better it is. If B80 is less than 1.1 T, a difference from the residual magnetic flux density (Br) becomes small, thus likely causing magnetic saturation.

In particular, for the reason described above, it is more preferable that B80 is not less than 1.2 T. A higher value of B80 can be obtained by increasing heat treatment temperature or performing specific heat treatment in a magnetic field. However, in this case, since the value of the residual magnetic flux density (Br) becomes high, an upper limit of B80 is substantially approximately 1.4 T.

In the present invention, the residual magnetic flux density Br obtained when magnetization is performed in the magnetic field of 80 A/m, and then the magnetic field is changed to 0 A/m is not less than 0.5 T and not more than 0.7 T. If Br is more than 0.7 T, the magnetic core is magnetically saturated when a fluctuation width corresponding to a design magnetic flux density is to be obtained from a biased magnetization state, so that an excessive rush current flows. Although the lower Br is preferable in terms of avoidance of occurrence of magnetic saturation of the magnetic core, if Br is as too low as less than 0.5 T, magnetization rotation becomes dominant in a magnetization process, so that noise increases.

In particular, for the reason described above, it is preferable that Br is not less than 0.6 T and not more than 0.7 T.

Further, in the present invention, a difference (B80−Br) obtained by subtracting Br from B80 is not less than 0.6 T. If the value of B80−Br is less than 0.6 T, magnetic saturation is likely to occur, and a high permeability from the biased magnetization state cannot be obtained (magnetic resistance is large), so that an excessive current flows to a primary winding.

In particular, for the reason described above, it is preferable that B80−Br is not less than 0.65 T.

Although an upper limit of B80−Br is not especially limited, the upper limit is practically approximately 0.8 T.

The Fe-based amorphous transformer magnetic core of the present invention may be manufactured by any method without any restriction as long as a magnetic core satisfying the above (1) to (3) can be obtained by the method; however, the Fe-based amorphous transformer magnetic core can be most suitably manufactured by a manufacturing method (the method of manufacturing the Fe-based amorphous transformer magnetic core of this invention) having the following processes (A) to (B):

(A) a process of stacking Fe-based amorphous alloy thin strips (ribbons) to produce a layered material, and (B) a process of heat-treating the layered material in a magnetic field of 0 A/m at a holding temperature set to be more than 300° C. but not more than a temperature that is 150° C. less than a crystallization starting temperature of the amorphous alloy for a holding time set to be not less than 1 hour but not more than 6 hours.

As described above, in the process (A), a magnetic core may be a so-called layered magnetic core in which a layered material is formed by stacking a desired number of strip-shaped thin strips each formed into a predetermined shape or a wound magnetic core obtained by winding a long web of thin strip (ribbon) around a desired magnetic core a desired number of times.

In the process (B), a layered material produced in the process (A) is heat-treated in an environment without applying a magnetic field. The heat treatment without applying a magnetic field (0 A/m) is especially suitable for a dramatic reduction in the residual magnetic flux density (Br).

The holding temperature held during the heat treatment is set in a range of more than 300° C. but not more than a temperature that is 150° C. less than the crystallization starting temperature of an amorphous alloy.

If the holding temperature is not more than 300° C., B80 becomes too low, and the value of B80−Br is in turn too low, so that magnetic saturation of a magnetic core cannot be prevented, and, in addition, the value of Br becomes too low, thus increasing noise. Moreover, if the holding temperature is more than 300° C., since distortion contained in the magnetic core is satisfactorily removed, performance variation for each magnetic core is reduced.

Meanwhile, if the holding temperature is in a range of more than the "temperature that is 150° C. less than the crystallization starting temperature of the amorphous alloy", an amorphous state of alloy cannot be stably maintained, and, in addition, Br becomes too high, thus likely causing the magnetic saturation of a magnetic core.

In particular, for the reason described above, the holding temperature is preferably more than 300° C. but not more than 340° C. and more preferably not less than 310° C. but not more than 330° C.

Here, the crystallization starting temperature of an amorphous alloy is measured as a heat generation starting temperature measured by a differential scanning calorimeter (DSC) when the temperature of an Fe-based amorphous alloy thin strip is raised from room temperature under a condition of 20° C./min.

The holding time during which a layered material is held at the above holding temperature during heat treatment is in a range of not less than 1 hour and not more than 6 hours.

If the holding time is less than 1 hour, the performance variation for each magnetic core increases. In this variation, B80 becomes too low, and the value of B80−Br is in turn too low, so that the magnetic saturation of a magnetic core cannot be prevented, and, in addition, the value of Br becomes too low, thus increasing noise. If the holding time is more than 6 hours, it is difficult to maintain the amorphous state of an alloy, and Br becomes too high, so that the magnetic saturation of the magnetic core is likely to occur. In particular, for the reason described above, it is preferable that the holding time is not less than 1 hour and not more than 6 hours.

In the present invention, the heat treatment is performed without applying a magnetic field and under an optimized holding temperature environment, whereby desired values of Br and B80 can be obtained. If the size of a magnetic core changes, a heat capacity changes, and therefore, it is desirable that the holding temperature and the holding time are optimized every time.

The Fe-based amorphous transformer of the present invention can be manufactured as a transformer provided with primary and secondary input/output terminals by winding a pair of conductive wires around a magnetic core manufactured by the above process.

Since the Fe-based amorphous transformer of the present invention can prevent occurrence of magnetic saturation, it is suitably connected to an output side of an inverter. The transformer of the present invention can be applied as a boosting transformer, an isolation transformer, or a step-down transformer. The transformer of the present invention is especially suitable for the boosting transformer.

As an alloy of an Fe-based amorphous alloy thin strip forming the Fe-based amorphous magnetic core of the present invention, an Fe—Si—B based alloy and an Fe—Si—B—C based alloy are preferable.

As the Fe—Si—B based amorphous alloy, preferred is an alloy of a system having a composition including 2 atomic percent to 13 atomic percent of Si and 8 atomic percent to 16 atomic percent of B with the balance substantially consisting of Fe and unavoidable impurities.

As the Fe—Si—B—C based amorphous alloy, preferred is an alloy of a system having a composition including 2 atomic percent to 13 atomic percent of Si, 8 atomic percent to 16 atomic percent of B, and not more than 3 atomic percent of C with the balance consisting of Fe and unavoidable impurities.

In any system, it is preferable that Si is not more than 10 atomic percent and B is not more than 17 atomic percent because a saturation magnetic flux density Bs is high. In an Fe—Si—B—C based amorphous alloy thin strip, if an excessive amount of C is added, secular change becomes great, and therefore, the amount of C is preferably not more than 0.5 atomic percent.

A thickness of an Fe-based amorphous alloy thin strip is preferably in a range of not less than 15 μm and not more than 40 μm and more preferably in a range of not less than 20 μm and not more than 30 μm. If the thickness is not less than 15 μm, it is advantageous because the mechanical strength of a ribbon can be maintained, the lamination factor is high, and the number of layers when the thin strips are stacked is reduced. If the thickness is not more than 40 μm, it is advantageous because eddy current loss is reduced, bending strain can be reduced when a magnetic core of a lamination is processed, and an amorphous phase is easily stably obtained.

In the Fe-based amorphous alloy thin strip, the length in the width direction orthogonal to the longitudinal direction (width length) is preferably not less than 15 mm and not more than 250 mm If the width length is not less than 15 mm, a large capacity magnetic core is easily obtained. When the width length is not more than 250 mm, an alloy thin strip in which uniformity in thickness in the width direction is high is easily obtained.

In particular, the width length is more preferably not less than 50 mm and not more than 220 mm in terms of obtaining a large capacity and practical magnetic core.

The Fe-based amorphous alloy thin strip can be manufactured by a well-known method such as a liquid quenching method (single roll method, twin roll method, centrifugal method, etc.). In particular, in the single roll method, a manufacturing facility is relatively simple, and stable manufacturing is enabled, and the single roll method is excellent in industrial productivity.

Figure 4:
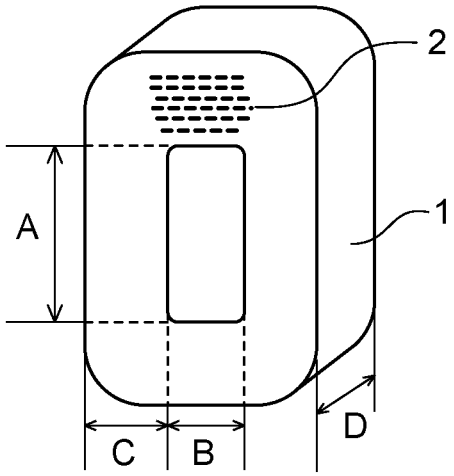
FIG. 4 is a schematic perspective view showing an example of an Fe-based amorphous magnetic core of the present invention.

The magnetic core of the present invention may have not only a circular shape but a rectangular shape as shown in FIG. 4. The magnetic core of this invention may be manufactured from a plurality of Fe-based amorphous alloy thin strips. Moreover, the magnetic core of this invention may have a joint of an overlap or a butt-lap.

EXAMPLES

Hereinafter, the present invention will be specifically described by referring to examples; however, this invention is not limited to these examples.

Example 1

—Production of Fe-Based Amorphous Alloy Thin Strip—

A long Fe-based amorphous alloy thin strip (alloy ribbon) having a width of 170 mm and a thickness of 24 μm and represented by a composition: $Fe_{81.7}Si_2B_{16}C_{0.3}$ (atomic percent) was produced by the following method, using a single roll method in the atmosphere. The unit of a composition ratio is "atomic percent".

Figure 3:
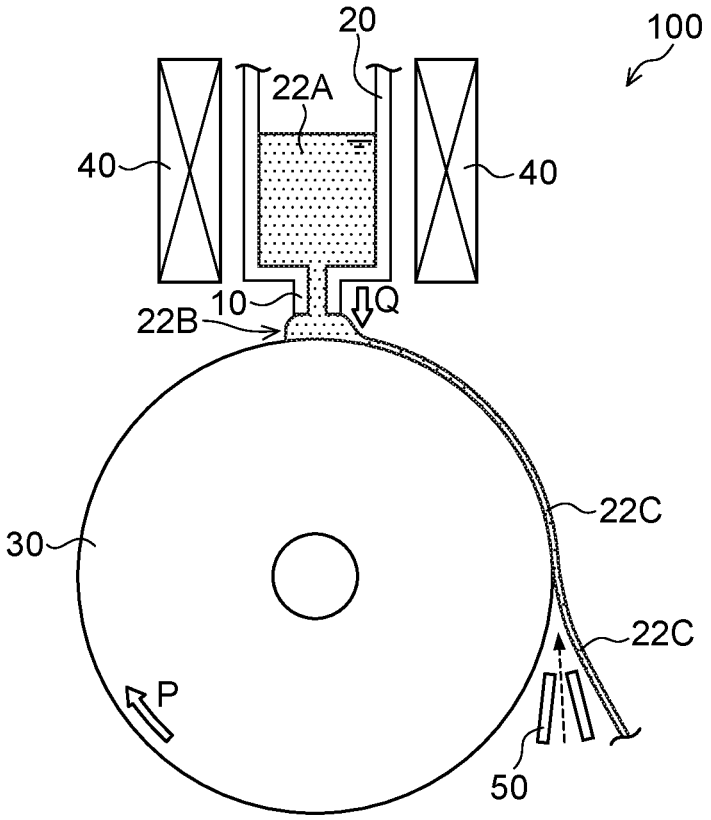
FIG. 3 is a schematic cross-sectional view conceptually showing an embodiment of a manufacturing apparatus for manufacturing an Fe-based amorphous alloy thin strip.

Specifically, an Fe-based amorphous alloy thin strip manufacturing apparatus similar to an apparatus 100 shown in FIG. 3 was provided. Here, the following cooling roll was used.

First, a molten alloy composed of Fe, Si, B, C, and unavoidable impurities (hereinafter also referred to as an Fe—Si—B—C based molten alloy) was prepared in a crucible. More particularly, a mother alloy composed of Fe, Si, B, and unavoidable impurities was melted, and carbon was added to the obtained molten metal, and melted and mixed to prepare a molten alloy for producing an Fe-based amorphous alloy thin strip having the above composition. Subsequently, the Fe—Si—B—C based molten alloy was discharged from a molten metal nozzle having a rectangular (slit shaped) opening with a long side length of 25 mm and a short side length of 0.6 mm, through the opening onto a surface of a rotating cooling roll for rapid solidification to produce 30 kg of an Fe-based amorphous alloy thin strip having a width of 170 mm and a thickness of 24 μm.

<Production Condition of Fe-Based Amorphous Alloy Thin Strip>

Cooling roll:

Material: Cu alloy

Diameter: 400 mm

Arithmetic average roughness Ra of cooling roll surface: 0.3 μm

Discharge pressure of molten alloy: 20 kPa

Circumferential speed of cooling roll: 25 m/s

Temperature of molten alloy: 1300° C.

Distance between molten metal nozzle tip and cooling roll surface: 200 μm

In measurement of each element, Si and B was measured by an ICP emission spectrometry, and C was measured by combustion in an oxygen airflow-infrared absorption method. The amount of Fe was obtained by subtracting the total amount of Si, B, and C from 100.

The saturation magnetic flux density (Bs) of the Fe-based amorphous alloy thin strip having the above composition was 1.63 T. An Fe-based amorphous alloy thin strip having a width of 10 mm and a length of 120 mm was used, and Bs was obtained as a maximum value (B8000) of a magnetic flux density of a direct current B-H curve measured by applying a magnetic field of 8000 A/m to the thin strip heat-treated under conditions of a heat treatment temperature of 320° C. and a holding time of 2 hours, while applying a DC magnetic field of 2400 A/m in a longitudinal direction of the thin strip.

The crystallization starting temperature obtained by a differential scanning calorimeter (DSC) was 490° C.

—Manufacturing of Magnetic Core—

The Fe-based amorphous alloy thin strip produced above was used, and as shown in FIG. 4, the alloy thin strip was cut into a predetermined size, and after the cut alloy thin strips were stacked, the alloy thin strips were wound around a core material having a predetermined size so as to have an overlap portion 2, whereby a layered material was produced.

Subsequently, the produced layered material was heat-treated by being held for 1 hour at each holding temperature (280° C., 300° C., 310° C., 320° C., 330° C., 340° C., 350° C., and 360° C.) shown in the following table under an environment without applying a magnetic field (a magnetic field of 0 A/m), whereby the magnetic core of the present invention (an Fe-based amorphous transformer magnetic core 1 shown in FIG. 4) and a magnetic core for comparison were manufactured.

In addition to the above magnetic core, the produced layered material was heat-treated at 330° C. for 1 hour while being subjected to a DC magnetic field of 12.5 A/m or 800 A/m in a magnetic path longitudinal direction, that is, a circumferential direction of a magnetic core, whereby a magnetic core for comparison was manufactured.

As the dimension (A, B, C, and D shown in FIG. 4) of a finally manufactured magnetic core, A=240 mm, B=80 mm, C=50 mm, and D=170 mm. The lamination factor (LF) of the magnetic core was 86%, and an effective cross-sectional area of the magnetic core was 73 $cm^2$.

The lamination factor LF of the magnetic core represents a ratio of a cross-sectional area of a thin strip in a cross-sectional area of a layered material of the thin strip and shows that the closer to 100%, the higher a ratio of the thin strip in the layered material.

In the calculation of the lamination factor of the magnetic core, a mass M of a thin strip piece cut from an Fe-based amorphous alloy thin strip into a size of a width W [mm] and a length of 2400 [mm] was measured, a thickness t1 [mm] of the Fe-based amorphous alloy thin strip was obtained from the following formula (a), and LF was calculated by the following formula (b).

$$t1=M/(W\times 2400\times \text{a density of amorphous alloy } [g/mm^3]) \quad (a)$$

$$LF=100\times \text{the number of times of stacking thin strips}\times t1/C \quad (b)$$

The above "density of amorphous alloy" is a value obtained by a fixed volume expansion method using a helium gas.

The effective cross-sectional area of the magnetic core was calculated by "effective cross-sectional area=C×D×LF".

—Wound Magnetic Core and its Characteristics—

Around a heat-treated magnetic core, a primary winding was wound with 30 turns, and a secondary winding was wound with 5 turns, and a direct current B-H curve was measured in a maximum magnetic field of 80 A/m by a DC magnetization characteristics testing device. A direct current B-H curve in which the holding temperature during heating was 300° C. or 330° C. is shown in FIG. 1. The residual magnetic flux density Br (T) and the magnetic flux density B80 (T) obtained when magnetization was performed in the magnetic field of 80 A/m were obtained based on the direct current B-H curve thus created, and a value of "B80−Br" was further obtained from these values. Those results are shown in the following Tables 1 to 3.

—Iron Loss of Wound Magnetic Core—

In each wound magnetic core in which the primary winding and the secondary winding were wound around the magnetic core as described above, the iron loss (W/kg) was measured when a frequency was 60 Hz and an exciting magnetic flux density was 1.3 T. The measurement results are shown in the following Table 4.

TABLE 1

<(1) B80>

Unit: [T]

| | | Holding temperature (° C.) | | | | | | | |
|---|---|---|---|---|---|---|---|---|---|
| | | 280 (Comparison) | 300 (Comparison) | 310 (This invention) | 320 (This invention) | 330 (This invention) | 340 (This invention) | 350 (Comparison) | 360 (Comparison) |
| Applied magnetic field (A/m) | 0 (This invention) | 0.96 | 1.06 | 1.14 | 1.22 | 1.29 | 1.39 | 1.45 | 1.49 |
| | 12.5 (Comparison) | — | — | — | — | 1.34 | — | — | — |
| | 800 (Comparison) | — | — | — | — | 1.53 | — | — | — |

In the above Table 1, B80 of not less than 1.1 T can be obtained at the holding temperature of not less than 310° C.

TABLE 2

<(2) Br>

Unit: [T]

| | | Holding temperature (° C.) | | | | | | | |
|---|---|---|---|---|---|---|---|---|---|
| | | 280 (Comparison) | 300 (Comparison) | 310 (This invention) | 320 (This invention) | 330 (This invention) | 340 (This invention) | 350 (Comparison) | 360 (Comparison) |
| Applied magnetic field (A/m) | 0 (This invention) | 0.44 | 0.48 | 0.50 | 0.57 | 0.60 | 0.66 | 0.73 | 0.87 |
| | 12.5 (Comparison) | — | — | — | — | 0.90 | — | — | — |
| | 800 (Comparison) | — | — | — | — | 0.79 | — | — | — |

As seen in the above Table 2, it is preferable to perform heat treatment without applying a magnetic field and at a low temperature in terms of reducing Br. Although the lower Br is preferable in terms of magnetic saturation, taking into consideration a balance with B80 shown in Table 1 and noise, Br is preferably in a range of 0.5 T to 0.7 T.

TABLE 3

<(3) B80 − Br>

Unit: [T]

| | | Holding temperature (° C.) | | | | | | | |
|---|---|---|---|---|---|---|---|---|---|
| | | 280 (Comparison) | 300 (Comparison) | 310 (This invention) | 320 (This invention) | 330 (This invention) | 340 (This invention) | 350 (Comparison) | 360 (Comparison) |
| Applied magnetic field (A/m) | 0 (This invention) | 0.53 | 0.58 | 0.64 | 0.65 | 0.69 | 0.72 | 0.72 | 0.61 |
| | 12.5 (Comparison) | — | — | — | — | 0.45 | — | — | — |
| | 800 (Comparison) | — | — | — | — | 0.74 | — | — | — |

In order to prevent magnetic saturation, the higher B80−Br, that is, a larger difference between B80 and Br is desirable. As seen in Table 3, even if Br shown in Table 2 is in a range of 0.5 T to 0.7 T, B80−Br as relatively high as not less than 0.6 can be obtained.

TABLE 4

<(4) Iron loss>

Unit: [W/kg]

| | | Holding temperature (° C.) | | | | | | | |
|---|---|---|---|---|---|---|---|---|---|
| | | 280 (Comparison) | 300 (Comparison) | 310 (This invention) | 320 (This invention) | 330 (This invention) | 340 (This invention) | 350 (Comparison) | 360 (Comparison) |
| Applied magnetic field (A/m) | 0 (This invention) | 0.36 | 0.33 | 0.30 | 0.29 | 0.26 | 0.24 | 0.23 | 0.29 |
| | 12.5 (Comparison) | — | — | — | — | 0.31 | — | — | — |
| | 800 (Comparison) | — | — | — | — | 0.21 | — | — | — |

It is found that the iron loss shown in Table 4 can be maintained low in the range of this invention shown in the above Table 1 or 2.

—Magnetic Saturation of Wound Magnetic Core—

Among the wound magnetic cores in the present invention, around the magnetic core heat treated at 330° C. without applying a magnetic field, a conductor was wound a predetermined number of times, and a boosting transformer of this invention in which a voltage on a primary side was 200 V, and a voltage on a secondary side was 6600 V was manufactured. In addition, for comparison, a conductor was similarly wound around a magnetic core, which was heat treated at 330° C. while the magnetic field of 800 A/m was applied in a circumferential direction of the wound magnetic core, whereby a boosting transformer for comparison having the same voltage was manufactured. Those transformers are boosting transformers assuming an output side of an inverter.

In such a state that a load is not connected to those two transformers, a rated voltage of 200 V was supplied to the primary winding. A rush current flowing to the primary winding at that time was recorded by an oscilloscope, and a peak value of a third wave of the rush current was measured. As a result, in the transformer of this invention, a current value was 25 A and not more than a rated current (50 A) of the produced transformer. On the other hand, in the transformer for comparison, a maximum current value of 175 A was detected, and a current not less than three times the rated current flowed to the primary winding. This is assumed to be a phenomenon occurring due to magnetic saturation.

Example 2

An Fe-based amorphous alloy thin strip (alloy ribbon) was produced similarly to Example 1, except that the composition of the Fe-based amorphous alloy thin strip in Example 1 was changed to the following composition, and a magnetic core was further manufactured. A wound magnetic core was obtained similarly to Example 1, using the manufactured magnetic core, and each characteristic was evaluated by a method similar to Example 1. The results are shown as follows.

Composition: $Fe_{79.7}Si_9B_{11}C_{0.3}$ (atomic percent)

TABLE 5

<(1) B80>

Unit: [T]

| | | Holding temperature (° C.) | | | | | | |
|---|---|---|---|---|---|---|---|---|
| | | 300 (Comparison) | 320 (Comparison) | 330 (Comparison) | 340 (Comparison) | 350 (This invention) | 360 (This invention) | 370 (Comparison) |
| Applied magnetic field (A/m) | 0 (This invention) | 0.93 | 1.03 | 1.10 | 1.15 | 1.25 | 1.30 | 1.38 |
| | 12.5 (Comparison) | — | — | — | 1.18 | — | — | — |
| | 1200 (Comparison) | — | — | — | 1.43 | — | — | — |

As shown in the above Table 5, as in Example 1, B80 of not less than 1.1 T can be obtained in a region where the holding temperature is not less than 310° C.

TABLE 6

<(2) Br>

Unit: [T]

| | | Holding temperature (° C.) | | | | | | |
|---|---|---|---|---|---|---|---|---|
| | | 300 (Comparison) | 320 (Comparison) | 330 (Comparison) | 340 (Comparison) | 350 (This invention) | 360 (This invention) | 370 (Comparison) |
| Applied magnetic field (A/m) | 0 (This invention) | 0.49 | 0.53 | 0.54 | 0.58 | 0.61 | 0.68 | 0.76 |
| | 12.5 (Comparison) | — | — | — | 0.84 | — | — | — |
| | 1200 (Comparison) | — | — | — | 0.83 | — | — | — |

As shown in the above Table 6, it is preferable to perform heat treatment without applying a magnetic field and at a low temperature in terms of reducing Br. Taking into consideration a balance with B80 shown in the above Table 5 and noise, Br is preferably in a range of 0.5 T to 0.7 T.

TABLE 7

<(3) B80 − Br>

Unit: [T]

| | | Holding temperature (° C.) | | | | | | |
|---|---|---|---|---|---|---|---|---|
| | | 300 (Comparison) | 320 (Comparison) | 330 (Comparison) | 340 (Comparison) | 350 (This invention) | 360 (This invention) | 370 (Comparison) |
| Applied magnetic field (A/m) | 0 (This invention) | 0.44 | 0.50 | 0.56 | 0.57 | 0.64 | 0.62 | 0.62 |
| | 12.5 (Comparison) | — | — | — | 0.34 | — | — | — |
| | 1200 (Comparison) | — | — | — | 0.60 | — | — | — |

As shown in the above Table 7, in the composition of the thin strip of this example, although Br shown in the above Table 6 is in a range of 0.5 T to 0.7 T in a region where the holding temperature is 350° C. to 360° C., B80−Br as relatively high as not less than 0.6 could be obtained.

TABLE 8

<(4) Iron loss>

Unit: [W/kg]

| | | Holding temperature (° C.) | | | | | | |
|---|---|---|---|---|---|---|---|---|
| | | 300 (Comparison) | 320 (Comparison) | 330 (Comparison) | 340 (Comparison) | 350 (This invention) | 360 (This invention) | 370 (Comparison) |
| Applied magnetic field (A/m) | 0 (This invention) | 0.38 | 0.34 | 0.37 | 0.35 | 0.32 | 0.32 | 0.33 |
| | 12.5 (Comparison) | — | — | — | 0.41 | — | — | — |
| | 1200 (Comparison) | — | — | — | 0.24 | — | — | — |

As described above, in the composition of the thin strip of this example, the iron loss shown in the above Table 8 could be maintained low, especially in the region where the holding temperature was 350° C. to 360° C.

The entire disclosure of Japanese Patent Application No. 2013-168215 is incorporated by reference in this specification.

All contents of the documents, patent applications, and technical standards described in this specification are incorporated herein by reference to the same extent as that when it is specifically and individually described that the respective documents, patent applications, and the technical standards are incorporated herein by reference.

The invention claimed is:

1. An Fe-based amorphous transformer magnetic core formed by stacking Fe-based amorphous alloy thin strips and satisfying the following (1) to (3) in a direct current B-H curve measured by applying a magnetic field of 80 A/m to the magnetic core:

$$B80 \geq 1.1\ T \quad (1)$$

$$0.5T \leq Br \leq 0.7\ T \quad (2)$$

$$B80 - Br \geq 0.6\ T \quad (3)$$

wherein B80 represents a magnetic flux density (T) obtained when magnetization is performed in the magnetic field of 80 A/m, and Br represents a residual magnetic flux density (T) obtained when a magnetic field is changed to 0 A/m after magnetization is performed in a magnetic field of 80 A/m, and wherein an alloy of the Fe-based amorphous alloy thin strips is alloy comprising 2 atomic percent to 13 atomic percent of Si, 8 atomic percent to 16 atomic percent of B, and not more than 3 atomic percent of C with the balance consisting of Fe and unavoidable impurities.

2. A transformer comprising:

the Fe-based amorphous transformer magnetic core according to claim 1; and at least a pair of conductive wires wound around the Fe-based amorphous transformer magnetic core.

3. The transformer according to claim 2 for connection to an output side of an inverter.

4. A method of manufacturing the Fe-based amorphous transformer magnetic core according to claim 1, comprising:

stacking Fe-based amorphous alloy thin strips to form a layered material; and heat-treating the layered material in a magnetic field of 0 A/m at a holding temperature set to be more than 300° C. but not more than a temperature that is 150° C. less than a crystallization starting temperature of the amorphous alloy for a holding time set to be not less than 1 hour but not more than 6 hours.

* * * * *